US005285916A

United States Patent [19]

Ross

[11] Patent Number: 5,285,916

[45] Date of Patent: Feb. 15, 1994

[54] PRESSURE VESSEL

[76] Inventor: Donald B. Ross, P.O. Box 423, Markham, Ontario, Canada, L3P 3R1

[21] Appl. No.: 19,526

[22] Filed: Feb. 19, 1993

[51] Int. Cl.[5] ..... B65D 51/16

[52] U.S. Cl. ..... 220/89.1; 220/902; 220/581

[58] Field of Search ..... 220/88.1, 89.1, 209, 220/203, 902, 581

[56] References Cited

U.S. PATENT DOCUMENTS

| | | | |
|---|---|---|---|
| 2,920,638 | 1/1960 | Heckethorn et al. | 220/89.1 |
| 2,923,403 | 2/1960 | Groves | 220/89.1 |
| 3,567,536 | 3/1971 | Wickersham | 156/78 |
| 3,703,976 | 11/1972 | Hughes et al. | 220/3 |
| 3,708,330 | 1/1973 | Harr | 117/94 |
| 4,294,279 | 10/1981 | Wyeth | 137/264 |
| 4,328,901 | 5/1982 | Gunderman et al. | 220/88 |
| 4,764,408 | 8/1988 | Stedman et al. | 428/71 |
| 4,765,458 | 8/1988 | Flanigen | 206/0.7 |
| 4,927,045 | 5/1990 | Lichka | 220/88 |
| 5,035,182 | 7/1991 | Durcell et al. | 220/89.1 |
| 5,117,999 | 6/1992 | Canzano et al. | 220/89.1 |

*Primary Examiner*—Joseph Man-Fu Moy

*Attorney, Agent, or Firm*—Seidel, Gonda, Lavorgna & Monaco

[57] ABSTRACT

A pressure vessel, comprising an aerosol can for containing gas under pressure, especially flammable gases such as butane, isobutane and propane. The vessel includes two features, an open celled foam, preferably reticulated and a pressure relief system and an opening in the container for discharge of gas or contents. The foam and the pressure relief system in combination substantially reduce the likelihood of flareout in use; and in storage, the buildup of heat in the event of fire, such that the vessels explode and become dangerous projectiles.

16 Claims, 3 Drawing Sheets

PRESSURE VESSEL

BACKGROUND OF THE INVENTION

1. Field of the Invention

This invention relates to a pressure vessel, in particular an aerosol can for containing gas under pressure, especially flammable gases such as butane, isobutane and propane. The pressure vessel comprises a container, an open celled foam, preferably reticulated, a pressure relief system, and an opening in the container for discharge of gas or contents. The foam and the pressure relief system in combination substantially reduce the likelihood of flareout from the vessel in use and in storage. When stored, the vessel design is such that the buildup of heat and pressure in the event of fire, such that the cans explode and become dangerous projectiles is substantially reduced or eliminated.

2. Description of the Related Art

The use of two-piece and three-piece aerosol cans for flammable material to be delivered under pressure is known. Containers of this type have been used for the packaging of a number of gases, but in the flammable liquified gas area, only butane and isobutane have been approved for packaging in such containers. Some aerosol containers are approved for use with non-flammable gas such as liquified chlorodifluoromethane (HCFC), having a pressure of 113.6 PSI-G (21.13 Bar) at 70° F. (21.11° C.) and 300 PSI-G (21.13 Bar) at 130° F. (54.4° C.). In a fire a non-flammable gas container reacts the same way as does a container of flammable gas, except that it does not burn. Butane and isobutane are considered low pressure liquified hydrocarbon gases, with pressures of 17 and 32 PSI-G, respectively, at 70° F. (21.11° C.). For propane, the pressure is 108–110 PSI-G at 70° F. (21.11° C.). Currently propane is not approved for packaging in any aerosol container. Propane is approved for use in one lb. and up cylinders which containers are subject to government regulations in both Canada and the United States which differ from the regulations governing aerosol containers. In the U.S., the Department of Transport is the governing authority, while in Canada it is Transport Canada. These government authorities and others such as the National Fire Protection Agencies regulate under penalty of law. Underwriters Laboratories also sets standards for such products, but approval is imposed as a result of commercial pressures.

Subsequent to the development of two- and three-piece aerosol cans, it became common to equip such cans with a pressure relief system when they were used to contain flammable gases with pressures of up to 45 PSI-G at 70° F. (21.11° C.). Examples of such systems are the rim vent system and the bottom vent system. These systems were meant to preclude explosion of these cans when subjected to high temperatures. These systems will be described in greater detail subsequently.

However, there remained an unsolved problem with the use of aerosol cans filled with liquified petroleum gas. This occurred in use, when the can was inverted and a welding torch or like appliance was secured to an actuator valve. The liquid phase of the gas moved to the actuator valve opening in the can, rather than remaining in the lower portion of the can, thus flooding the actuator valve when activated. In such instance, the liquid phase of the liquified gas surged to the actuator valve opening, frequently creating a condition called flareout which could cause a dangerous fire situation. In fact, it is quite common for handbooks associated with devices of this type to include a warning that the aerosol vessel or container should not be inverted when used.

Attempts have been made over the years to find a solution to flareout by introducing to the attached appliances, parts, such as diaphragms and back pressure valves. The diaphragm was the least expensive but the most ineffective. The back pressure relief valve was considered to be effective, but it was expensive to make, insert and test, and unfortunately, when inserted into the appliance, it wasn't always 100% failsafe. These solutions were associated with the appliance and not the fuel container.

It was also observed that when aerosol vessels or cans equipped with a pressure relief system became overheated, the rapidly expanding liquified petroleum gas (LPG), being one mass in the can and under pressure, forced the dome to evert and on a rim vent can, the vents to fracture as the can pressure increased. In the case of bottom vent pressure relief systems, which usually comprise a coin-shaped score mark on the concave bottom of the can, the score mark fractures as the can heats up and the gas expands to just below the burst pressure of the can. When this occurs and the pressure relief system of the can opens, allowing the gas to escape, the released gas then ignites to form a fireball. In a warehouse fire, where a quantity of aerosol cans without either device might be stored, the fireball created could become quite large and the force propelled on by the fireball could cause not only undue fire damage, but also structural damage to a building. In a situation where such cans had a pressure relief system, it has been found also that the flames from the fireball were often sucked back into the cans before the entire amount of the gas had been exhausted, creating violent explosions with the cans becoming projectiles and causing more than fire damage to property.

The use of foam in fuel tanks and fuel storage containers to prevent explosions is well known having been used extensively in military aircraft fuel tanks and in racing cars. The following patents typify such applications.

| U.S. Pat. No. | Issue Date | Inventor(s) |
|---|---|---|
| 3,567,536 | March 2, 1971 | William W. Wickersham, Jr. |
| 3,703,976 | Nov. 28. 1972 | William L. Hughes, et al |
| 3,708,330 | Jan. 2, 1973 | G. B. Harr |
| 4,294,279 | Oct. 13, 1981 | Harold W. G. Wyeth |
| 4,328,901 | May 11, 1982 | Robert J. Gunderman, et al |
| 4,764,408 | Aug. 16, 1988 | Donald R. Stedman, et al |
| 4,765,458 | Aug. 23, 1988 | Edith M. Flanigen |
| 4,927,045 | May 22, 1990 | Helmut J. Lichka |

None of these patents describes an aerosol container for gases of any type.

It is understood that there have been on the market, aerosol cans for butane and isobutane (propane may not be used) which contain foam for the purpose of overcoming surge of the liquid phase of the gas when the aerosol can is inverted. Such products are said to be supplied by Sakae Seiki Co. Ltd. and Yoshinaga Prince Co. Ltd., both of Japan. The use of foam in a can has proved to be far more effective than other methods in eliminating surge problems when the full fuel can is inverted. However, such cans have not incorporated a pressure relief system, which meant that although the problem of surging or flaring was avoided, the difficulty of storing aerosol containers holding flammable materials under pressure was not. In one of these designs, the foam is a reticulated foam and has a centrally located hole extending from the top to halfway down the foam. The hole received a double dip tube attached to the actuator valve which acts to reduce or eliminate surge or flareout. The primary purpose of the double dip tube is to stop surge and allow time for the liquid phase of gas to vapourize when the can is inverted. The function of the foam is secondary as it retains the liquid phase of the gas within its cell structure, stopping the surge to the actuator valve when the can is inverted. Without the foam the double dip tube would rest in the liquid gas phase. This design was found to be too expensive for use in a can of fuel and was discontinued. There are also on the market small aerosol packages of flammable gas, such as butane and isobutane, as well as very small containers of butane for curling irons, small torches and lighters.

SUMMARY OF THE INVENTION

However, there remains a need for a safe aerosol container which would meet the requirements of both use and storage as set out and which would be inexpensive and use a state of the art manufacturing process. There is a need for smaller packages of flammable gaseous fuels such as propane, particularly in the torch market. The typical home owner would prefer to purchase an aerosol package of such fuel as it could be used quickly and eliminate the need for long term storage in the home and its associated concerns.

The present invention is directed to a vessel for gas under pressure, comprising a container, an open-celled foam sized to fit within the container, a pressure relief system, and an opening in the container for discharge of the gas.

Unexpectedly, the combination of the foam and a pressure relief system provides improved safety features for an aerosol can. The foam has the ability not only to prevent surging, but also to even out and slow the flow of escaping, highly pressured gas when the can is overheated, and the pressure relief system has been activated. In the case of a Crown rim vent system, the velocity of the gas moving through the foam cell structure is such that the can refrigerates from the bottom up, reducing the temperature of the gas and hence lowering the internal pressure of the can. In a Sexton can, the foam retains the liquid phase of the gas within its cell structure and hence reduces vapour phase flow of gas to the HPR opened pressure relief system. In the case of the Crown rim vent system, in a fire situation, the reduced flow of gas results in flames being intermittently extinguished and then reignited for short periods of time.

It is also significant that the size of the aerosol container provides less of an environmental problem than the typical one pound cylinders in use, which containers are not capable of being recycled. Further, there is currently capability as well as efforts being made to recycle aerosol containers, given the approximately three billion aerosol packages used in North America for packaging of all types of products.

Figure 1:
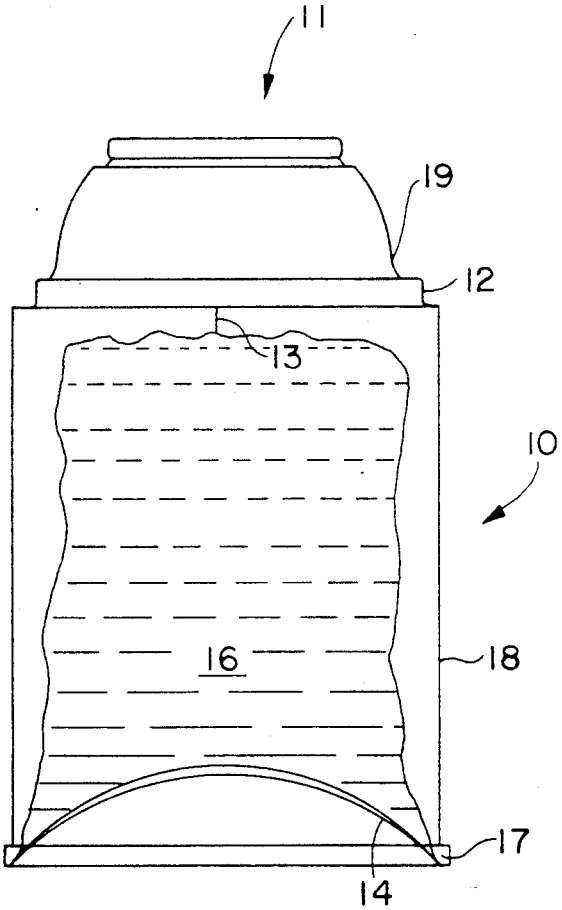
FIG. 1 is a cut-away front view of a pressure vessel according to the invention which incorporates a rim vent pressure relief system in a three-piece aerosol container.
Figure 2:
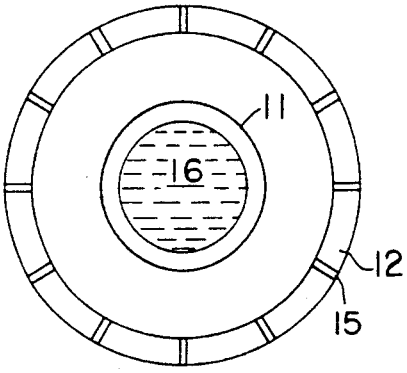
FIG. 2 is a top view of the rim vent pressure release system of FIG. 1.
Figure 3:
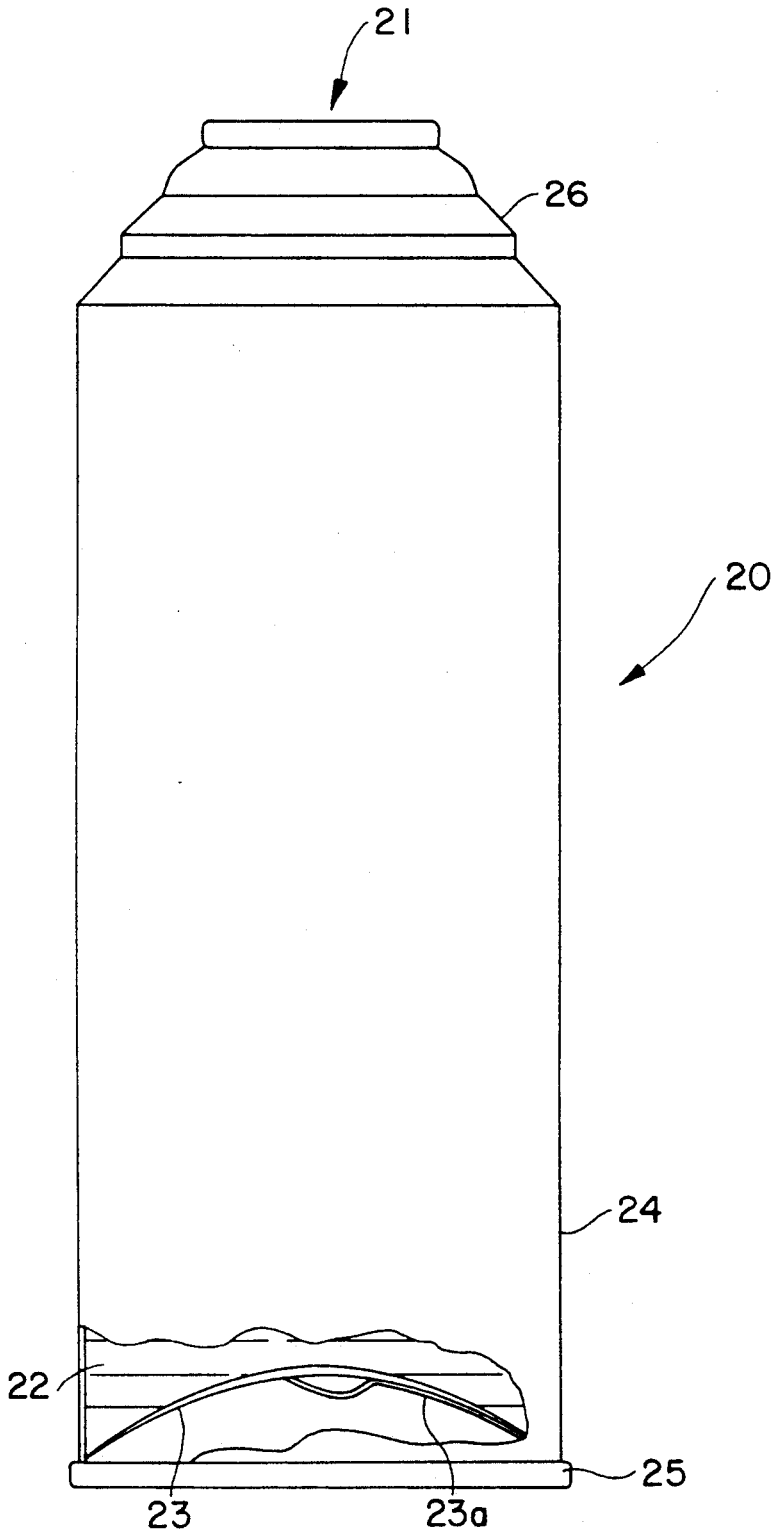
FIG. 3 is a partially cut-away front view of a pressure vessel according to the invention which incorporates a bottom vent pressure release system in a two-piece aerosol container.

There are generally two types of aerosol cans which incorporate pressure relief systems presently on the market and these have been found to be useful in the present invention. One system provides for a dome rim vent pressure relief system and is produced by Crown Cork & Seals Co., Ltd., and is shown in FIGS. 1 and 2 of the drawings while the other provides for bottom vent relief and is obtainable from Sexton Can Co., Inc. and is shown in FIG. 3 of the drawings. While these particular systems have been found to be effective, others are available and any which meet the usual requirements would be acceptable for use.

DETAILED DESCRIPTION OF THE INVENTION

Referring first to FIGS. 1 and 2, there is shown a three-piece aerosol can sold commercially by Crown Cork & Seal Co. Inc. which is designated generally at 10 in FIG. 1. The can 10 includes a top dome 19 which is secured to a cylindrical body 18 via a top double seam 12. The body 18 is formed with a welded side seam 13. The can 10 has a concave bottom piece 14 which is secured to the body 18 via a bottom double seam 17. An opening 11 is provided in the top of the dome 19. Through this opening 11, foam 16 may be inserted into the can 10. The opening 11 is sized to receive an aerosol valve (not shown) of a conventional type.

In FIG. 2, there is shown a top view of can 10 which illustrates a rim vent pressure relief system incorporated into the can. The opening 11 is visible, as is foam 16. Equidistantly spaced along top double seam 12 which may conveniently be referred to as a rim are 12 sets of three-transverse scores which upon the development of internal pressure can be stretched and fractured, when the can is overheated, allowing the over pressurized gas to escape.

Referring now to FIG. 3 of the drawings, designated generally at 20 is a two-piece aerosol can sold by Sexton Can. Co., Inc. which incorporates a bottom vent pressure release system. The can 20 comprises a body 24 which includes a top portion 26 narrowed in step-wise fashion to an opening 21 to which may be secured a conventional aerosol valve (not shown) and through which foam 22 may be added. The body 24 has secured to its bottom end a concave piece 23 by means of a mechanical double seam 25.

In a cutaway section of can 20, foam 22 can be seen as can a coin-shaped score **23*a* in concave piece 23. This score may be stretched and fractured to provide pressure relief upon build-up of pressure within the can 20**.

Figure 4:
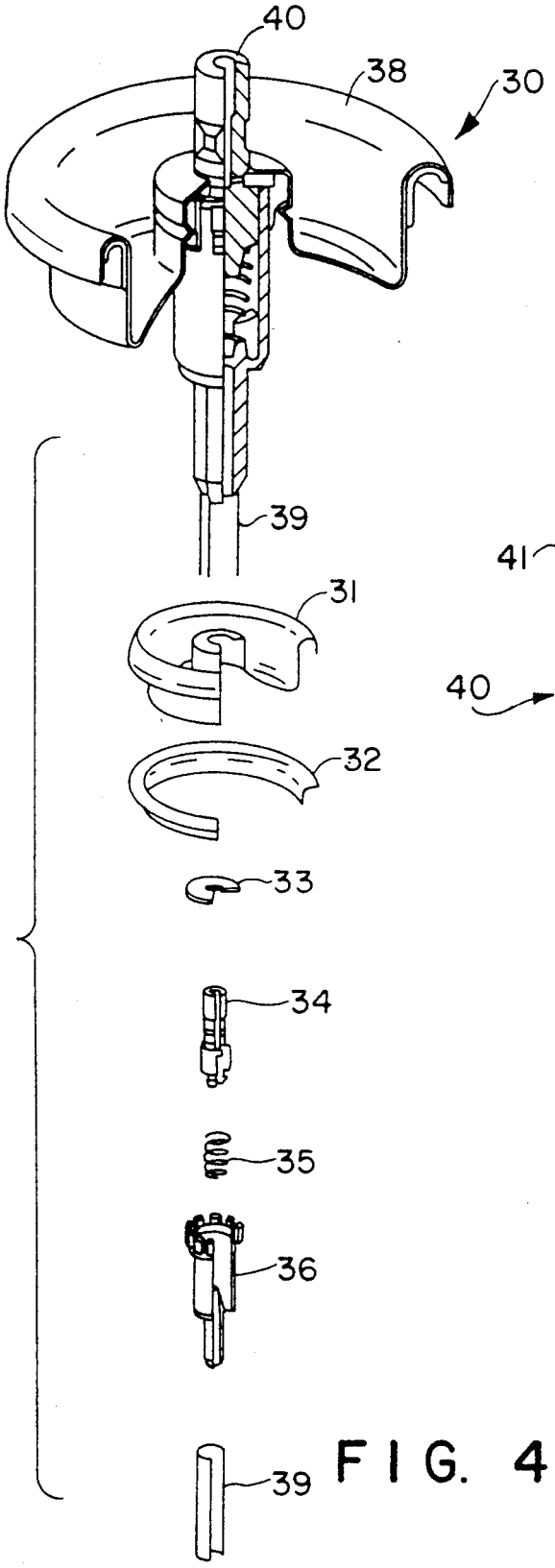
FIG. 4 is an exploded cross-section of an actuator valve for use in a pressure vessel according to the invention.
Figure 5:
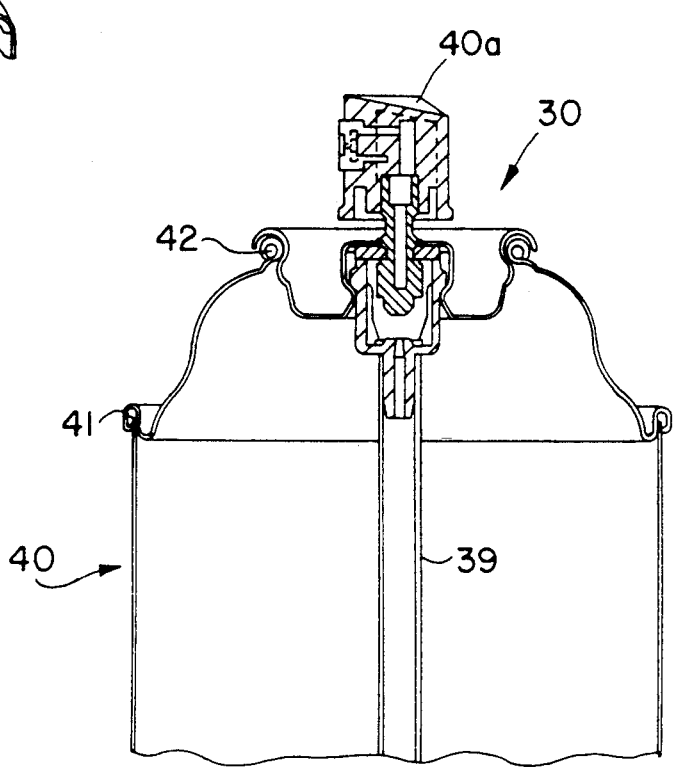
FIG. 5 is a partial cross-section of the valve of FIG. 4 secured to an aerosol container.

Referring now to FIGS. 4 and 5, there is shown a standard actuator valve designated generally at 30 which ma be secured to an aerosol can, designated generally at 40 (shown in partial view). The valve 30 comprises a mounting cup 31, a cup gasket 32, a stem gasket 33, a stem 34, a spring 35, a housing 36 and a dip tube 39 which is optional. The valve 30 includes a raised exterior pedestal 40 and a mounting cup 38. The cup 38 allows the valve 30 to be crimped securely to the opening rim 42. Typically the cup and opening are each about one inch in diameter. The pedestal 40 may be threaded or unthreaded. An appliance with an actuator pin maybe threaded on to the pedestal or a actuator button (40*a*) maybe pressed on to the stem (40) as shown in FIG. 5.

In the rim vent design, the relief system is built into the dome 19 of the container 10, while in the bottom high pressure vent system, the pressure relief system is built into the concave bottom 23 of the container 20. In practice when either can 10 or 20 becomes overheated, the pressure relief system in each case opens and allows gas to escape immediately, lowering the internal pressure. In the present invention, the foam 16 or 22 in the cans 10 and 20, respectively, restricts the gas flow to the respective pressure relief system. In the case of can 10, and the rim vent system, as the gas from the foam 16 escapes through the pressure relief system opening 15, the can 10 refrigerates from the bottom up, reducing the temperature of the gas and thereby reducing the flow of gas to the pressure relief system and any aerosol valve (not shown) but secured to opening 11 of the container 10. As a result the circumstances necessary for an explosion do not develop.

The rim vent relief system consists of twelve sets of three scores 15 on metal in the top double seam 12 surrounding the bottom of the dome top 19. This system opens at around 180 PSI-G (12.67 Bar). These scores 15 are opened when the can 10 becomes overheated and the pressure in the can 10 forces the dome 19 to evert, stretching the scores 15 which then fracture.

In the bottom vent pressure relief system, there is only one coin-shaped or circular-shaped score 23*a*, which fractures when the can 20 becomes overheated, usually when the can pressure reaches 315–480 PSI-G (22.18–33.80 bar).

Generally, other types of cans may be used in this invention as long as they are able to withstand pressures of up to and including 500 PSI-G (35.21 bar), but not less than 80% of the maximum pressure of the contents at 130° F. (54.4° C.)at 180 PSI-G (12.67 bar), whichever is greater. While steel or aluminium may be used for can 10, the preferred maximum steel specifications for the can body 18, have been found to be as follows:

a) the thickness of the lower portion of the can body 18, 24 is 0.0085" (0.216 mm) minimum, and b) shoulder thickness is 0.017" (0.433 mm).

The requirements for can body 24, which must be made of steel in this instance, have been found to be as follows:

a) the thickness may be 0.0085" minimum throughout, b) a service pressure of 240 PSI-G min., and c) a test pressure of 300 PSI-G min.

Steel or aluminum are typical of metal cans 10, 20, but other suitable materials may be used to manufacture the cans 10, 20, for example ceramic material may be used.

The preferred pressure and capacity requirements are as follows:

Transport regulatory requirements for three-piece 2P and two and three piece 2Q cans 10 and 20, the specifications for which are set by both DOT and TC and were mentioned earlier.

For 2P containers, the pressure must not exceed 160 PSI-G (11.27 bar) at 130° F. (54.4° C.).

For 2Q containers, pressure must not exceed 180 PSI-G (12.68 bar) at 130° F. (54.4° C.).

The capacity of the cans 10 and 20 must not exceed 32.5 cubic inches (532.58 m or 18.0 fluid ounces).

The maximum service pressure of the cans 10 and 20, must not exceed 240 PSI-G (16.90 bar).

In addition, it is a requirement that the cans 10 and 20 must not be filled to more than 87 volume percent, at ambient temperature. This is another requirement set by DOT and TC.

Referring again to FIGS. 4 and 5, when the pressure vessel is an aerosol container 10, 20, the pressure vessel has a prescribed one inch opening 11, 21 into which a one inch mounting cup 38 of the actuator valve 30 is placed and then crimped to the can 40 for discharge of the contents. The valve mounting cup 38 usually has a raised exterior pedestal 40 which can be threaded or unthreaded. An appliance such as a torch or stove or lantern (not shown), preferably provided with a securing means, may be attached to the pedestal 40. Alternative actuator valve arrangements are possible, for example there are valve cups, with an exterior collar of about ¼" width. This collared valve at the present time is used almost exclusively on small portable liquified petroleum gas stoves, wherein the collar acts as a locking device when the can is inserted into the fuel receptacle of the stove.

The foam 16 and 22 that is used inside the aerosol can 10, 20 may be added in a number of ways. It may be put in place, having been previously manufactured and cut to size and shape, or it may be poured into the container 10, 20 and foamed in place. In both methods, the foam 16, 22 may be added to the can 10, 20 through the top opening 11, 21, which is preferably one inch diameter. In certain instances, the foam 16, 22 may be placed in the body of the can 10, 20 before the bottom 14, 23 of the can 10, 20 is put in place, usually by crimping.

Generally the foam 16, 22 may be characterized as an opened-celled foam which is further described as having a three-dimensional interconnective strand structure of membranes of varying widths and containing up to 97% or more of voids between the strands.

The foam 16, 22 may have a varying number of voids dispersed throughout its mass, thus its density can vary, the voids being interconnected by strands of membrane. The basic polymer of the foam 16, 22 may vary, but may be selected from the group consisting of polyhydrocarbon foam, such as polystyrene, polybutadiene, polyisoprene, polyethylene, polypropylene, copolymers of such polymers and blends thereof, or any other foamable material such as polyvinylchloride polyethers and polyesters, with the only qualification being that the gases to be placed in the can, are absolute or liquified, non-flammable, such as nitrogen, chlorodifluoromethane or flammable such as butane, isobutane and propane which do not attack the foam. It is important to remember that such materials may be the end product or they may be used as a propellant in conjunction with other finished products such as ethyl ether or hairspray.

Preferably the foam 16, 22 is an open-celled, flexible, reticulated foam made from any of the previously noted polymers. One example of a suitable foam is polyurethane which may be formed by mixing an organic polyiisocyanate, usually more than one mol, with a reactive material containing hydrogen, usually one mol, for example polyester polyols, water, fluorohydrocarbon and catalyst. The foam 16, 22 may be reticulated as a bun and later cut and shaped to fit inside the interior dimensions of the aerosol can 10, 20 cavity. The reticulation may occur in accordance with any of the known processes in the art.

In tests conducted with respect to this invention, foams 16, 22 found to be of use may be further characterized as being reticulated polyurethane foams having preferably a porosity from about 20 to 80 PPI, more preferably 30 or 60 PPI (pores per inch). Tests have shown that a foam 16, 22 having a pre-formed rectangular shape rather than a conical shape when used in a Sexton can 20 performed best. The rectangular shaped foam melted less than conical shaped foam (it had less contact with the surface of the can) when the can 20 became overheated and before the pressure relief system was activated. The more a foam melts, the more gas vapours are released and hence a much larger flame is produced when the pressure relief system has been activated.

While the reticulated, flexible, open-celled foam is preferred, other non-reticulated and/or rigid foams could be used depending on the manufacturing conditions and end product to be packaged.

Optionally, a fire retardant additive may be added to the foam 16, 22, as this has been found to provide an additional safety feature in certain instances. Any of the known foam fire retardants may be used, one example being that provided by Great Lakes Chemical under the code number DE 60F which is understood to be brominated diphenol ether. The presence of the fire retardant has been found through tests to be effective in providing flame resistance to the small amount of foam which may from time to time protrude from the Sexton can 20 opening 21, upon actuation and opening of the bottom (coin-shaped 23*a*) vent pressure relief system. Melting appears only to occur when the foam 22 remains in the overheated can 20 before the bottom HPR has been activated. This same melting phenomenon was not observed with the cans 10 having the Crown rim vent relief system.

Foams which have been tested to determine efficiency in this invention include a polyurethane foam supplied by General Foam Corporation of New Jersey sold under the trade mark VELVE. The foam is a reticulated open-celled flexible foam.

As indicated, the pressure vessel described herein is meant to contain flammable or non-flammable gases, liquified or absolute. Examples of such gases are butane, isobutane, propane, oxygen, hydrogen, nitrogen, carbon dioxide and mixtures of such gases. These substances may be used as a fuel cell or as propellants (for example in the case of the hydrocarbon gases such as butane, isobutane and propane), in combination with other substances. The cans 10, 20 may be filled up to 87% by volume of material to be discharged when loaded at ambient pressure.

The following tests illustrate the properties and advantages of the present pressure vessel.

FIELD FIRE TEST

Purpose

The purpose of this test was to show the advantages of the can of the present invention over other known cans under conditions which would simulate a warehouse fire.

Test Apparatus

The App holding positions for 6-211x604 cans. Immediately over the can holders was constructed a clamping device bolted to the apparatus was constructed from heavy angle iron with apparatus, which fit over the domes of the cans and could be removed or left on during the series of tests. Over the top of the holder was constructed an umbrella-like screen built of tubular metal about ½ inch in diameter, and spaced about 2 inches apart which covered the whole apparatus. This was bolted to the apparatus with ¼ inch bolts before the testing began. The clamping device and the metal screen could be used together or separately. Both the clamping device and metal screen were used when the cans to be tested did or did not have a pressure relief system. The screen was used when the cans had just a pressure relief system and foam. The apparatus was equipped with two burner elements, one placed underneath the can holders while the other burner was placed at the side of the holder assembly. Both burners could be used to heat the cans or could be used independently. Both burners were connected by rigid copper piping to a shut off valve at the apparatus and to this was connected a 25 ft. flexible approved gas line, connected to a 20 lb. tank of propane which had a fast shut off valve.

Components

Rectangular and conically shaped reticulated polyurethane, polyester and a hybrid of both foams, having a ppi(pores per square inch) of 40 to 60.

Crown Cork & Seal (CC&S) 3 piece 2P Rim Vent Release (RVR) steel can, (meeting D.O.T.49CF, Regulation 173.304 (d)(3)ii, Note 1 & 2.

Sexton 2 piece 2Q+ Bottom Vent High Pressure Release (HPR) steel can, (meeting D.O.T.49CF, Regulation 39, under permit E9393)

Newman & Green K28 and K28-22 actuator valve

Liquified Petroleum gases, isobutane A31 & propane A108.

Method

Three reticulated foams, Yellow, Grey & Charcoal (Black) shaped in rectangles and cones were placed in both the Crown Cork & Seal (CC&S) and Sexton cans. The Newman & Green (NG) K28 and K28-22 valves were crimped into the 1 inch opening of each of the cans. Fourteen of the thirty-nine Sexton cans tested were gassed with propane while the remaining 25 CC&S cans were gassed with isobutane. The Two Sexton cans and four CC&S cans were gassed without the foam labelled as control cans. The cans were then placed into the testing apparatus according to the type of foam, type of can and type of gas. Around the apparatus about a foot from each side, was mounted a metal wind screen, fastened to a tubular frame, and then hammered into the ground. The bottom burner of the apparatus was then ignited. A video camera put in place to record each series of tests was then turned on to record the tests.

Observations

The Newman & Green K 28 valve failed in 33⅓% of the cans gassed with A31 and in 14% of the cans gassed with A108. In the 66% of the cans gassed with A31, the RVR (rim vent relief valve) vented as specified. Initially there was no apparent flame at the RVR and when it did ignite, the ignition was intermittent. The can refrigerated from the bottom up reducing the temperature in the can, thereby reducing the internal pressure. After the initial fire at the RVR had subsided, there was no wick flame effect. The Sexton can having a bottom HPR (high pressure relief valve) and the burner in the apparatus being located just under the bottom of the can in this series of tests, ignition took place immediately the HPR opened, and after the initial flame had passed, there was still a small flame left(wicking) at the opening of the HPR, from apparently some residue gas left in the foam. Any foam that was protruding from the HPR was burnt or where the foam had not contained a fire retardant had melted. Where the HPR had opened wider than specified, some of the foam just inside the opening had also melted. In the 33⅓% of the cans where the NG K28 valve had malfunctioned, it was noted in all cases the valve's internal housing had melted.

When the pressure relief system, of either CC&S or Sexton control cans opened, there was a large violent fire ball created. At first, the Grey foam appeared to be the best foam at resisting melting of the three foams tested. However it was only slightly better in this respect than the Black foam which did not contain a fire retardant. Overall, the Black foam performed best. With three of the Sexton cans in the test group, the bottoms inverted before the HPR opened. There was a noticeable difference in volume of flame in the CC&S cans gassed with propane compared with that of the Sexton cans, when the pressure relief systems opened.

In a later series of tests, using exclusively Sexton cans with high pressure relief (HPR) systems, charged with propane and using NG 28-22 valves, where the burner of the apparatus was placed at the side of the cans rather than at the bottom, the test results were different. The housings of the valves did not melt to the same extent (1.6%) as in the first series of tests. It was observed that the lower the fill of gas (down to 170 g from 220 g), the longer it took for the PRS to open. On average this time was 25 to 30 seconds. This resulted in less incidents of the K28-22 valve housing melt down when compared to the K28 valve test data. As a result less valve housings of the K28-22 valve melted. This was interpreted to mean better performance standards were obtained with the lower fill level, which decreased the dwell time to almost 0, for the housing of the valve to melt and the HPR to open. In addition, it was observed that the scoring in the bottom HPR of the Sexton can would have to be held to closer tolerances when flammable gases were packaged in this way.

Conclusion

The longer it took the pressure relief system (PRS) to open (measured in seconds), the greater the chance of the valve housing melting and releasing gas through the stem of the valve. Because of this the K28 valve was rejected. In some cases with the Sexton can, in the first series of tests, valve meltdown occurred before the PRS opened. The data received from these series of tests confirmed that the gas had been absorbed into the interwinding membrane stand structure of the foam cells, which slowed the gas movement to the open RVR or HPR of the cans, thereby reducing the size of flame developed ( for flammable gases) when the RVR or HPR opened and ignition occurred. The foam, however, in the CC&S cans was found to be more intact, as less melting took place than in the Sexton can. This was due mostly to the burner in the apparatus being directly under the bottom of the Sexton cans having the HPR.

Unexpected Results

Surprisingly, a state of the art foam, Black (charcoal), 60 ppi, outperformed the foam of first choice used in the first series of tests manufactured by Scott Paper Company. The Scott foam was first thought to be superior because it carried a military specification (MIL) and had already been used in racing car and military aircraft fuel tanks. The Scott foam was tested in the Sexton and Crown cans but was rejected after these overheated Sexton and Crown cans blew apart and became projectiles at the end of the second of five tests. A second surprise was the dwell time required for the foam to function 100% effectively, i.e. the time from when heat is first applied to the time just before the melting point of the valve housing is reached and the PRS opens and vents 99% of the gas. The third surprising observation was in the shape of the foam. It was first thought the conical shaped foam would be the shape of choice because it filled all of the void of the can. The unexpected result was that the rectangular form proved superior because only the four corners of the foam touched the interior walls of the can. Thus, it received less heat transfer as heat was applied to the can. In such instance, the rectangular foam remained more or less intact, as compared with the conical foam, when the PRS opened. This was true for both types of cans.

Notes

The foam in all cases stopped an explosion occurring and the can from becoming a projectile.

STATIC WATER BATH TEST

Purpose

The purpose of the water bath test was to determine the production line safety, for propane fill levels of either 170 g or 220 g cans in Sexton foam and non-foam filled cans.

Components

Rectangular and conically shaped 60 ppi (as per specs.) polyurethane foam.

Sexton 2 piece steel 2Q+ (meeting D.O.T. Regulations 39).

Newman & Green K28-22 valve having a 2Q steel cup.

Liquified Petroleum gas propane A108.

Method

Six Sexton cans were filled with propane, three (no. 1, 4 and 5) having 170 g fill , while the three other cans (2, 3 and 6) having 220 g fill, one of which (#6) as control had no foam. Before each of the cans was gassed, there was drawn 20 inches of mercury vacuum. The actual crimping of the K28-22 valve to the can was completed on a production line. The preshaped foam (rectangular) was placed in the can prior to gassing. The filling of the gas into the can was done at room temperature (approx. 70° to 72° F.)(21.11° to 22.72° C.) with the gas at 108 to 110 PSI-G(7.45 to 7.50 bar).

The cans were then submerged in the water bath to a depth of approx. 8 to 10 inches of water with the water bath being preheated to 135° F.(57.22° C.), and where the magnetic track of the bath had been stopped. Each can had been numbered on the side and bottom of the can for identification purposes. The temperature of the water was recorded continuously throughout the bath, by an automatic digital temperature gauge as well as from time to time with a hand held thermometer.

Observations and Results

Two of the six cans, nos. 3 and 6 that had been filled to 220 g, had the high pressure relief valve (HPR) open. The no. 6 can had no foam in place and when the HPR opened, the can lifted off the magnetic track of the water bath. The can struck a heavy wire safety screen above the water bath twice, which slowed it down, but it still travelled another 40 or 50 feet from its initial location. The no. 3 can containing the foam, when its HPR opened stayed in its original position on the water bath magnetic track, while its gas contents were exhausted through the open HPR. After the gas had been exhausted, the can floated to the surface of the water. Upon examination there was no distortion of this can as there had been for no. 6. The third can (no.2) which had a 220 g fill did not have its HPR open. It remained on the track throughout the 20 to 30 mins. in the bath. (A normal water bath production test lasts about 1 to 2 mins.) After 15 mins. in the heated water bath, the pressure in the cans stabilized at a given temperature. Leaving the cans in the water bath longer was to put full stress on the score of the HPR bottom.

The remaining three cans (nos. 1,4 and 5) with the 170 g fill all remained intact, on the track throughout the test.

The above tests are believed to show conclusively that (A) an aerosol can filled with liquified gas, with no pressure relief system when overheated, explodes and becomes a projectile. When filled with flammable gas, the explosion causes a massive and violent fire;

(B) an aerosol can filled with liquified gas with a pressure relief system when overheated, becomes a projectile. When the gas is flammable, a large fire ball is created at the PRS; and (C) an aerosol can filled with liquified gas with a PRS and specific type of foam does not explode nor does it become a projectile when the can becomes overheated, even if the can is over filled. If the gas is flammable, the fire at the PRS is controlled.

From the above description of the general principles and preferred embodiments of the present invention, those skilled in the art will readily comprehend the various modifications to which the present invention is susceptible.

I claim:

1. A vessel for gas under pressure comprising a container, an open-celled foam, sized to fit within the container, a pressure relief system which is activated upon an increase in the internal pressure of the container when filled with gas under pressure and as a result of overheating the container, and which in combination with the foam prevents surging of the gas, flare out and container explosion, and an opening in the container having an actuator valve secured thereto for discharge of the gas under pressure.

2. A vessel as claimed in claim 1 wherein the foam is a reticulated open-celled foam.

3. A vessel as claimed in claim 2 wherein the foam is flexible.

4. A vessel as claimed in claim 3 wherein the foam is selected from the group consisting of polyurethane, polyether, polyester, and hybrids of polyether and polyester foams.

5. A vessel as claimed in claim 1 wherein the gas is flammable.

6. A vessel as claimed in claim 5 wherein the gas is selected from the group consisting of butane, isobutane, propane, hydrogen, oxygen or a mixture of such gases.

7. A vessel as claimed in claim 1 wherein the gas is non-flammable.

8. A vessel as claimed in claim 7 wherein the gas is liquified chlorodifluoromethane.

9. A vessel as claimed in claim 1 wherein the gas is the propellant and the vessel contains other material for discharge.

10. A vessel as claimed in claim 4 wherein the foam is rectangular-shaped.

11. A vessel as claimed in claim 4 wherein the foam is in the shape of a cone or a cylinder.

12. A vessel as claimed in claim 1 wherein the container is an aerosol can.

13. A vessel as claimed in claim 12 wherein the container is a two-piece or three-piece aerosol can.

14. A vessel as claimed in claim 12 wherein the vessel is portable.

15. A vessel comprising a container adapted for containing a gas under a pressure of greater than 15 PSI-G, an open-celled foam, sized to fit within the container, a pressure relief system which is activated upon an increase in the internal pressure of the container when filled with gas under pressure, and which in combination with the foam prevents surging of the gas, flare out and container explosion, and an opening in the container having an actuator valve secured thereto for discharge of the gas under pressure.

16. A vessel as claimed in claim 15 wherein the pressure relief system is activated at a pressure greater than 150 PSI-G.

* * * * *